US007155884B2

(12) United States Patent
Cousins et al.

(10) Patent No.: US 7,155,884 B2
(45) Date of Patent: Jan. 2, 2007

(54) STRETCH WRAP THREADING DEVICE

(75) Inventors: Neil G. Cousins, Tottenham (CA); Boris Radovanovic, Mississauga (CA); Srbislav Davidovic, Oakville (CA)

(73) Assignee: Cousins Packaging, inc. (CA)

( * ) Notice: Subject to any disclaimer, the term of this patent is extended or adjusted under 35 U.S.C. 154(b) by 0 days.

(21) Appl. No.: 10/781,257

(22) Filed: Feb. 18, 2004

(65) Prior Publication Data

US 2004/0163364 A1 Aug. 26, 2004

Related U.S. Application Data

(60) Provisional application No. 60/448,215, filed on Feb. 18, 2003.

(51) Int. Cl.
*B65B 53/00* (2006.01)
*B65B 1/20* (2006.01)
*B65B 63/02* (2006.01)

(52) U.S. Cl. ..... 53/556; 53/203; 53/211; 53/212; 53/436; 53/520; 53/523

(58) Field of Classification Search ..... 53/556, 53/203, 211, 212, 399, 397, 419, 430, 436, 53/113, 122, 520, 523; 493/460, 461
See application file for complete search history.

(56) References Cited

U.S. PATENT DOCUMENTS 2,952,371 A * 9/1960 Smith ..... 414/26
4,712,686 A * 12/1987 Lancaster et al. ..... 206/597
5,352,320 A * 10/1994 Schwartz et al. ..... 156/494
5,491,956 A * 2/1996 Donnelly et al. ..... 53/399
5,575,138 A * 11/1996 Reigrut et al. ..... 53/556
5,768,862 A * 6/1998 Mauro ..... 53/556
5,836,140 A * 11/1998 Lancaster, III ..... 53/399

* cited by examiner

*Primary Examiner*—Christopher Harmon
(74) *Attorney, Agent, or Firm*—Price, Heneveld, Cooper, DeWitt & Litton, LLP

(57) ABSTRACT

A stretching device for a stretch wrap machine includes a support structure and a film support for rotatably holding a roll of stretchable film. First and second rollers are rotatably mounted to the support structure. The stretching device includes a take-off device for supporting film as it is fed from the stretching device. A power drive assembly includes a motor, and the power drive assembly is configured to rotate the first and second rollers to stretch a film between the rollers. The stretching device further includes an elongated flexible member forming a loop and having a connector adapted for securing stretchable film. A guide assembly adjacent first ends of the first and second rollers movably supports the elongated flexible member to guide stretchable film through the stretching device. A disengagable drive is operably coupled to the elongated flexible member to provide powered movement of the elongated flexible member. The drive member is disengagable from the motor such that the first and second rollers can be rotated under power while the elongated flexible member is disengaged from the motor. The stretching device may be utilized with wrapping machines having a rotatable base or a turntable, or with wrapping machines of the type having an arm that rotates to wrap film about packages. The stretching device may include a tensioning device that tensions the chain.

16 Claims, 11 Drawing Sheets

STRETCH WRAP THREADING DEVICE

CROSS-REFERENCE TO RELATED APPLICATION

This application claims the benefit of U.S. Provisional Application No. 60/448,215, filed Feb. 18, 2003, the entire contents of which are hereby incorporated herein by reference.

BACKGROUND OF THE INVENTION

The present invention relates to a threading device and, more particularly, relates to a device for threading a web through a series of rollers in a stretch wrapping apparatus.

During the past two decades, considerable developments have been made in the field of wrapping a load with a stretched web of film. Most notably, the film web dispenser used in stretch wrapping operations has developed to the extent that it contains a series of rollers which defines a path through which the web passes so that it can be prestretched prior to being dispensed on the load.

Such stretch wrapping apparatus performs admirably in accomplishing its intended goal of wrapping a load with a stretched web of film. However, the procedure of threading the film web through the series of rollers in the film web dispenser prior to operation of the stretch wrapping apparatus has been found to be time consuming and difficult. This is especially true now because of the development of film web dispensers having increased numbers of rollers and also because such rollers are often closely spaced and difficult to turn because of their effective interconnection for prestretching the film web prior to dispensing the film web on the load.

SUMMARY OF THE INVENTION

One aspect of the present invention is a film dispenser of a stretch wrap machine. The film dispenser includes a stretching device having a support structure and a film support for rotatably holding a roll of stretchable film. First and second rollers are rotatably mounted to the support structure, each of which defines a first end. The film dispenser includes a take-off device for supporting film as it is fed from the stretching device. A power drive assembly includes a motor, and the power drive assembly is configured to rotate the first and second rollers to stretch a film between the rollers. The film dispenser further includes an elongated flexible member forming a loop and having a connector adapted for securing stretchable film. A guide assembly adjacent the first ends of the first and second rollers movably supports the elongated flexible member to guide stretchable film through the film dispenser. The power drive assembly includes a disengagable drive that is operably coupled to the elongated flexible member to provide powered movement of the elongated flexible member. The drive member is disengagable from the motor such that the first and second rollers can be rotated under power while the elongated flexible member is disengaged from the motor. The film dispenser may be utilized with wrapping machines having a rotatable turntable. Alternately, the stretching device may be utilized with wrapping machines of the type having an arm that rotates the film dispenser about packages to wrap the film. The elongated flexible member may comprise a chain, and the guide assembly may include a plurality of sprockets. The film dispenser may include a tensioning device that tensions the chain.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
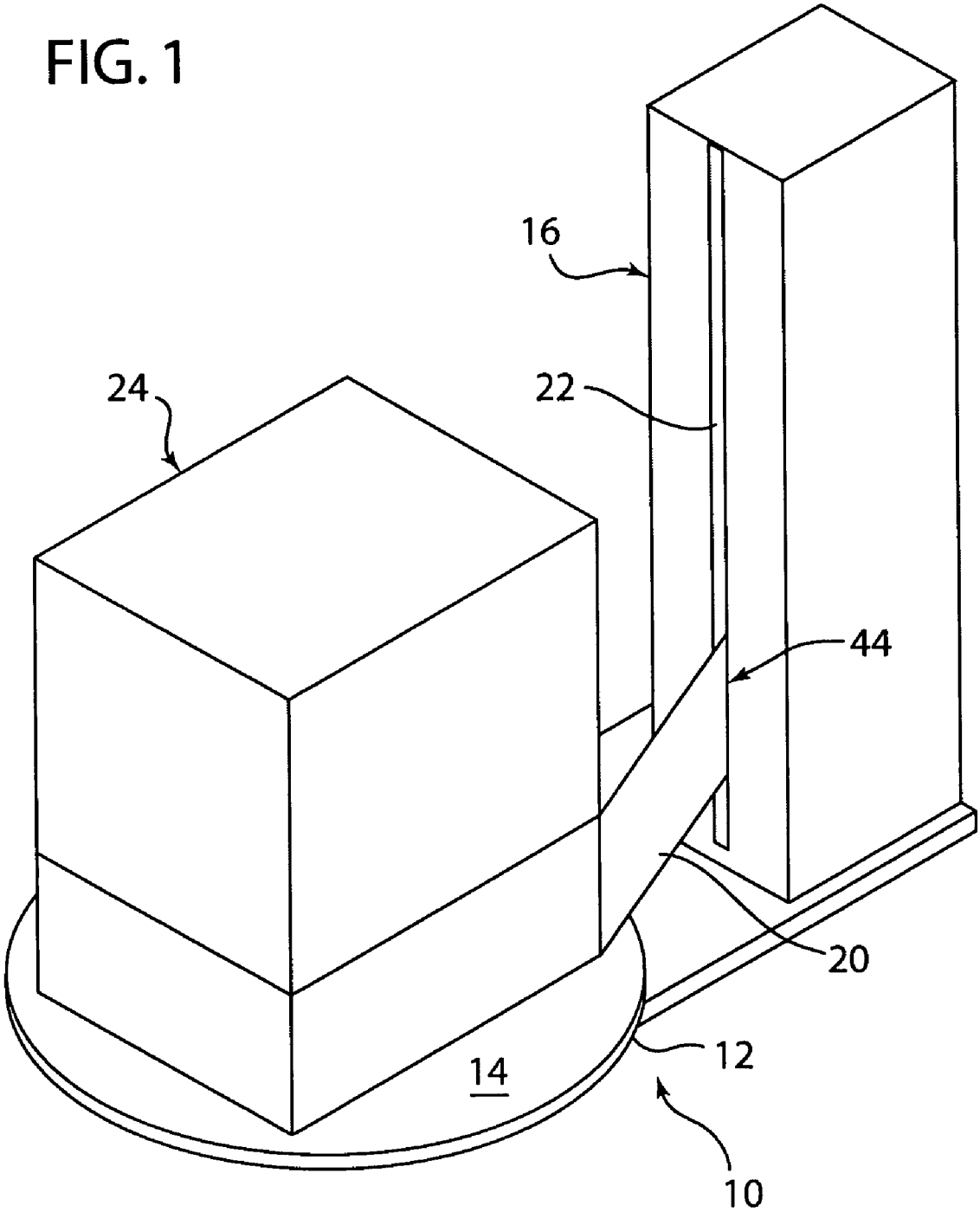
FIG. 1 is a perspective view of a wrap machine of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
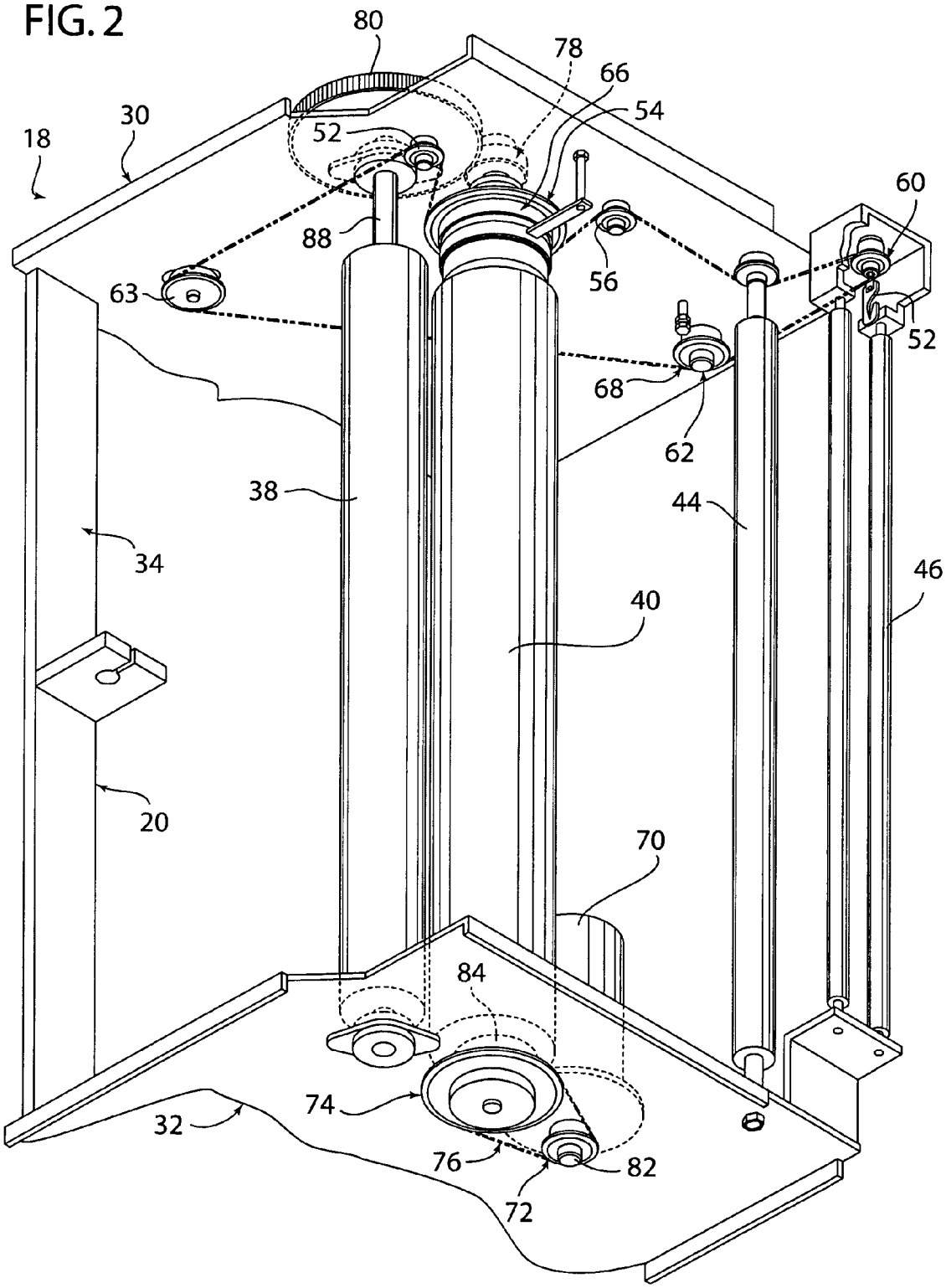
FIG. 2 is a bottom front perspective view of a carriage of the present invention without a motor.
Figure 3:
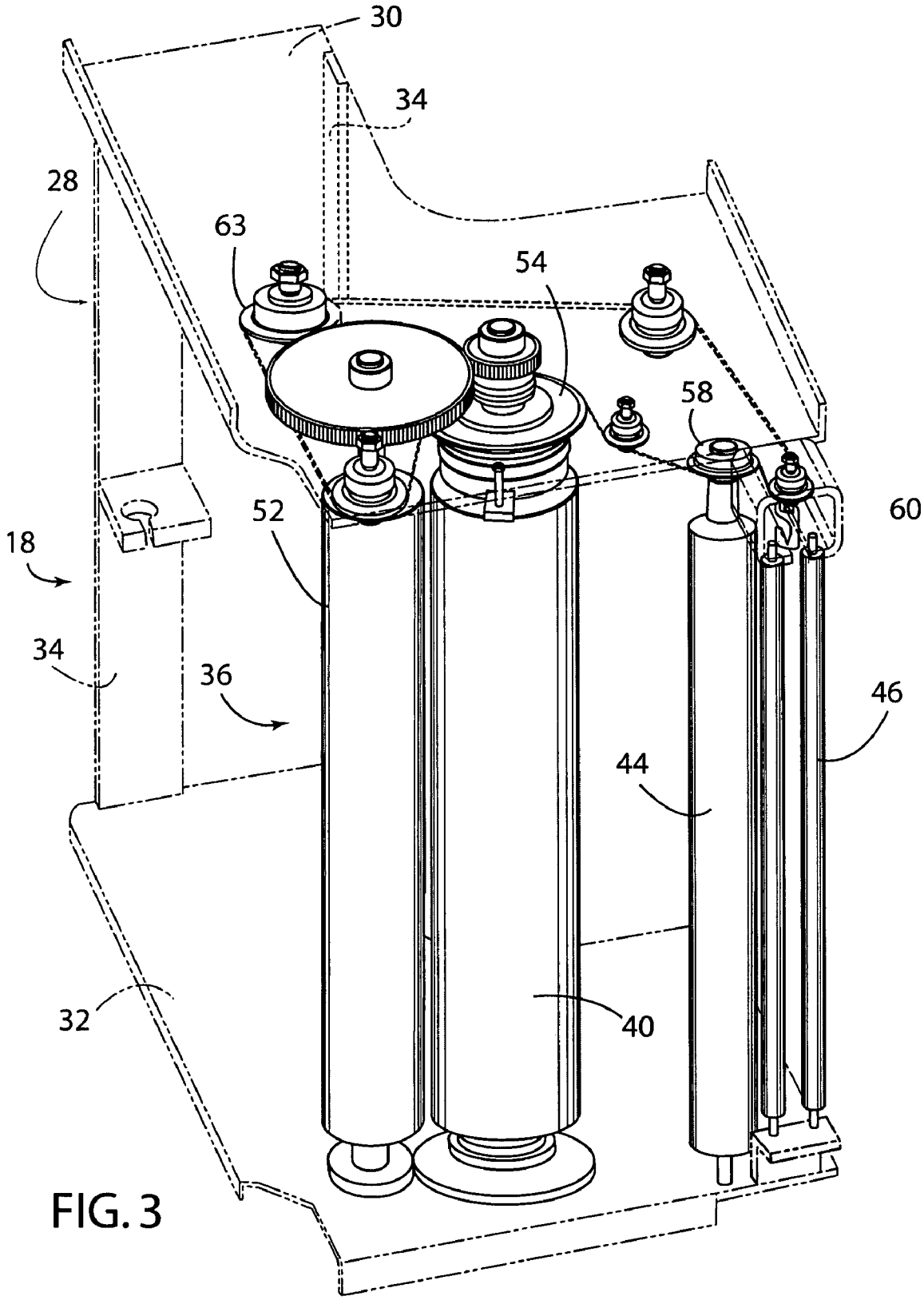
FIG. 3 is a top front perspective view of the carriage of the present invention without the motor.
Figure 4:
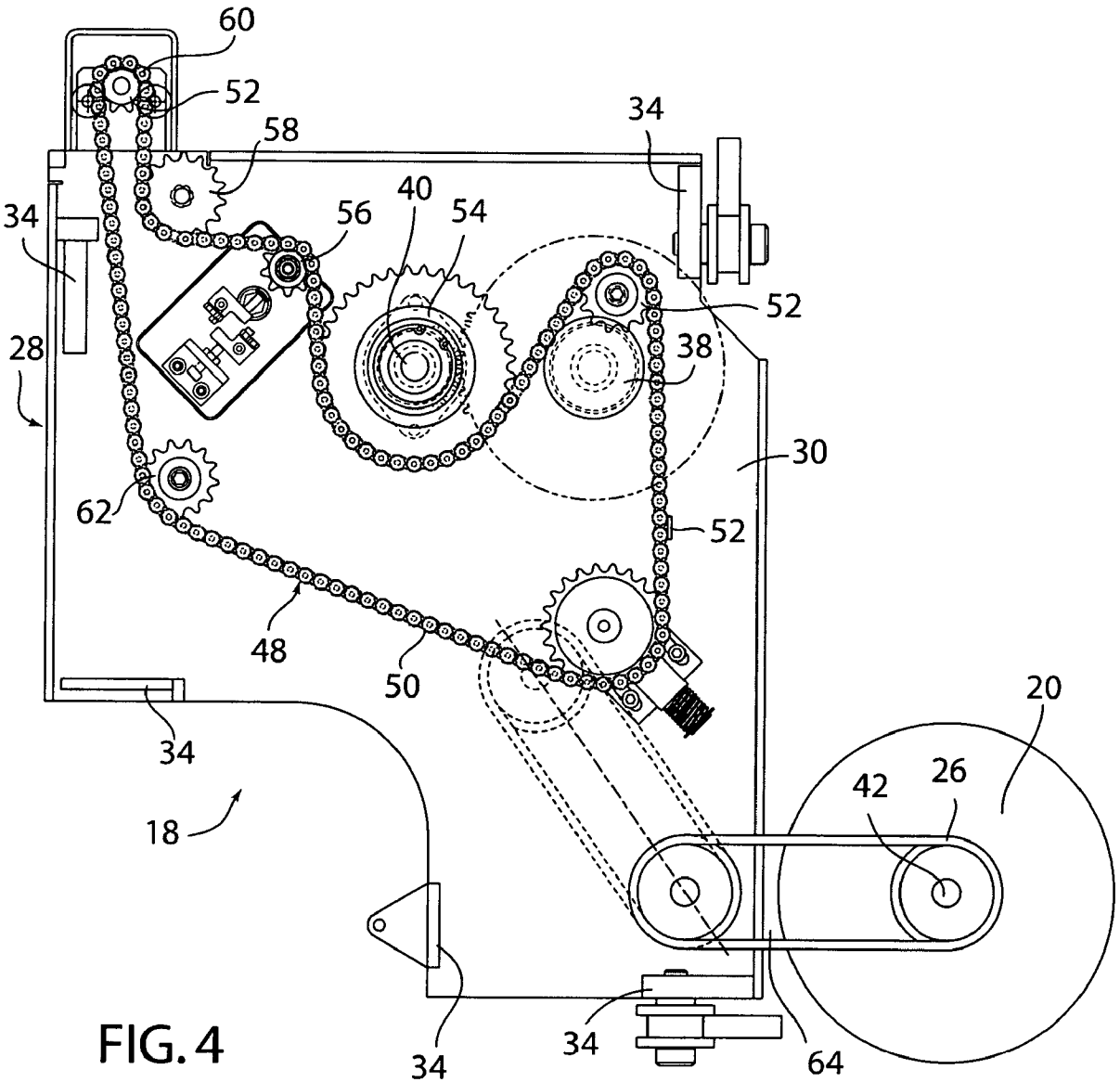
FIG. 4 is a top view of the carriage of the present invention without the motor.
Figure 5:
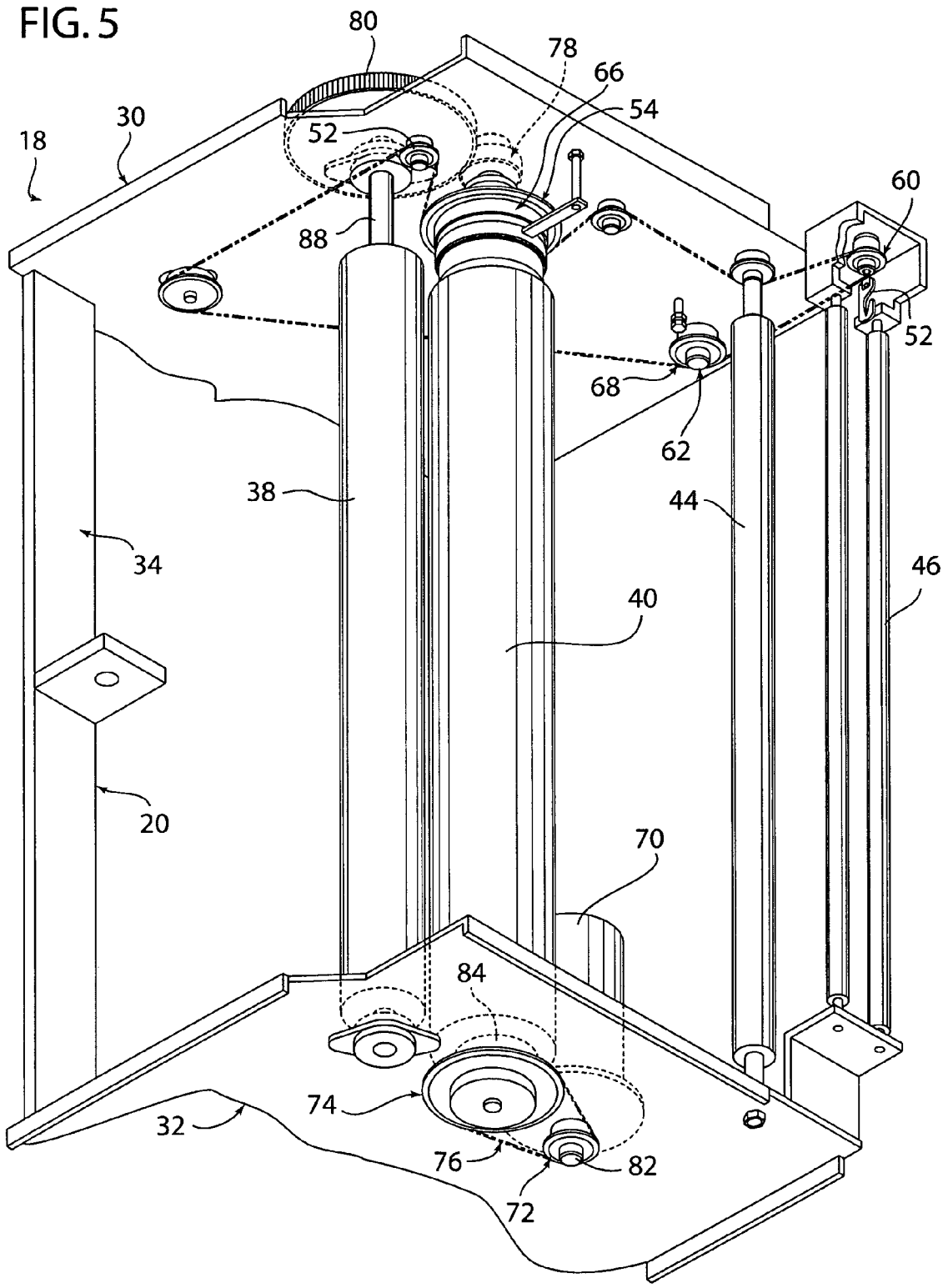
FIG. 5 is a bottom front perspective view of the carriage of the present invention with the motor.
Figure 6:
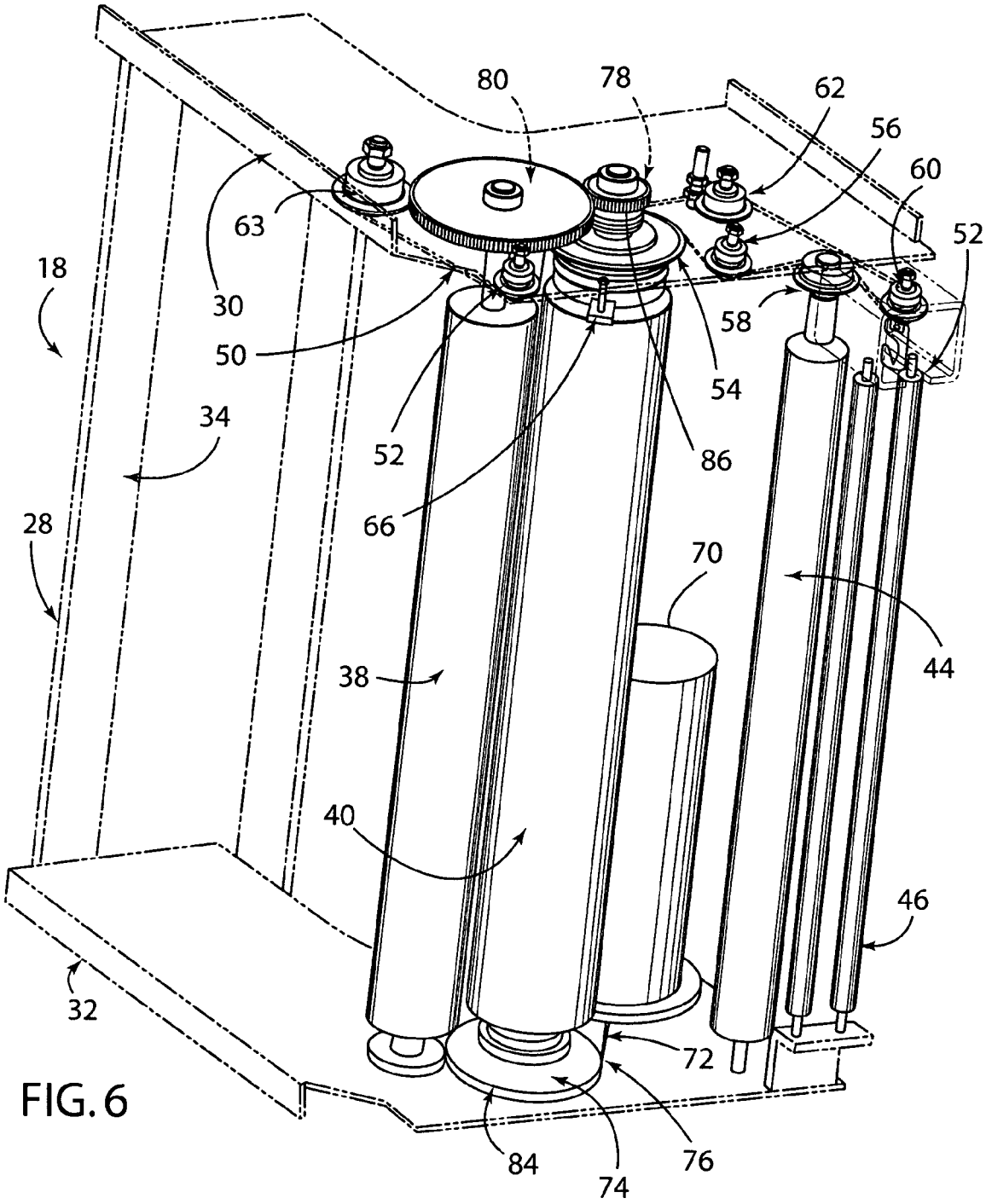
FIG. 6 is a top front perspective view of the carriage of the present invention with the motor.
Figure 7:
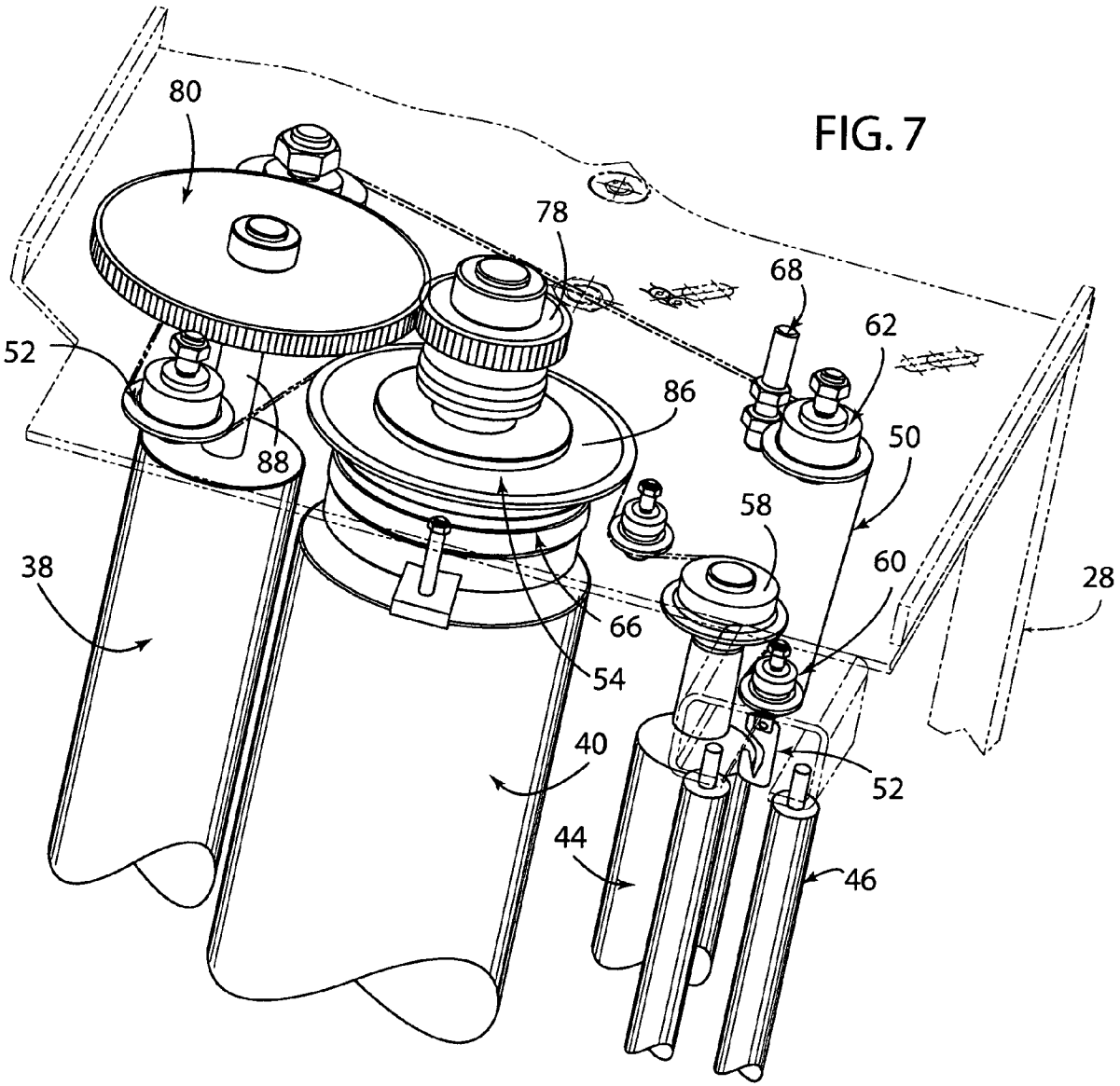
FIG. 7 is a top close up perspective view of the carriage of the present invention with the motor.

The reference number 10 (FIG. 1) generally designates a wrap machine of the present invention. The wrap machine 10 includes a base 12 having a turntable 14 mounted thereon. The wrap machine 10 further includes a column 16 having a vertically movable film dispenser or carriage 18 (FIGS. 2–4) located therein. Stretch wrap 20 moves with the carriage 18 and exits the column 16 through a vertical slot 22 in the column 16. The stretch wrap 20 wraps a package 24 mounted on the turntable 14 and rotating therewith. Although not shown, the wrap machine 10 may also include a gripping and cutting device for gripping the stretch wrap 20 and cutting the stretch wrap 20 during certain portions of the process of wrapping the stretch wrap 20 about the package 24. Such gripping and cutting devices are well known to those skilled in the art.

In the illustrated example, the carriage 18 (FIGS. 2–7) includes a source of the stretch wrap 20 and moves the source of stretch wrap 20 vertically in order to wrap the package 24 between a top and a bottom of the package 24. Preferably, the source of stretch wrap 20 includes a roll 26 of stretch wrap 20 placed on the carriage 18. The carriage 18 preferably prestretches the stretch wrap 20 in order to lengthen the stretch wrap 20 in a manner known to those skilled in the art. It will be readily understood that the wrap machine may include a support arm or the like that supports carriage 18 for rotation about a stationary package 24. If this configuration is utilized, wrap machine 10 does not include a turntable 14, but relies instead on movement of carriage 18 to wrap package 24.

The carriage 18 includes a housing 28 having a top plate 30, a bottom plate 32 and a plurality of struts 34 connected to the top plate 30 and the bottom plate 32, thereby providing a rigid structure to the carriage 18. The housing 28 can be moved vertically within the column 16 by many methods, all of which are well known to those skilled in the art. The carriage 18 also includes a source of power connected thereto in a manner well known to those skilled in the art.

The illustrated carriage 18 includes an S-wrap roller system 36 for prestretching the stretch wrap 20 coming from the roll 26 of stretch wrap 20. The S-wrap roller system 36 includes a first roller 38 and a second roller 40 extending between the top plate 30 and the bottom plate 32 of the housing 28. The first roller 38 preferably has a 3-inch diameter and the second roller 40 preferably has a 4-inch diameter. The S-wrap roller system 36 includes a motor 70 connected to the second roller 40 by means of a sprocket 72 on an output shaft 82 of the motor 70, a chain 76 and a sprocket 74 on a lower axle 84 of the second roller 40. The first roller 38 is linked to the second roller 40 by a second gear 80 on the upper axle 88 of the first roller 38 and by a first gear 78 on an upper axle 86 of the second roller 40. The first gear 78 on the upper axle 86 of the second roller 40 is smaller than the second gear 80 on the upper axle 88 of the first roller 38. Accordingly, the first roller 38 and the second roller 40 rotate at different speeds, with the first roller 38 rotating slower than the second roller 40. Therefore, as the stretch wrap 20 moves through the first roller 38 and the second roller 40 of the S-wrap roller system 36, the stretch wrap 20 stretches in a manner that is well known to those skilled in the art.

In the illustrated example, the stretch wrap 20 on the roll 26 is delivered through the carriage 18 and out the vertical slot 22 in the column 16 to wrap the package 24. The roll 26 of stretch wrap 20 is positioned on a mandrel 42 within the housing 28 of the carriage 18. The stretch wrap 20 departs the roll 26 and moves around the first roller 38 and the second roller 40 of the S-wrap roller system 36, around a third roller 44 and out between a pair of film take-off rollers 46. The pair of take-off rollers 46 extends out the column 16 through the vertical slot 22.

The illustrated carriage 18 includes a film delivery system 48 for moving a front end of the stretch wrap 20 through the carriage 18 when a new roll 26 of stretch wrap 20 is placed on the carriage 18. The film delivery system 48 includes a threading chain 50 having a pair of film delivery hooks 52 thereon for pulling the front end of the stretch wrap 20 through the carriage 18. The threading chain 50 rides on a first sprocket 52, a second sprocket 54 aligned with the second roller 40, a third sprocket 56, a fourth sprocket 58 aligned with the third roller 44, a fifth sprocket 60 located between the pair of take-off rollers 46, a sixth sprocket 62 and a seventh sprocket 63.

The stretch wrap 20 is fed through the carriage 18 by the film delivery system 48 when the roll 26 of stretch wrap 20 is empty. Once the roll 26 is empty, a user of the wrap machine 10 presses a button (not shown) that tells a control system of the wrap machine 10 to move the carriage 18 to a load position. The load position is preferably a centrally located height of the column 16. Once the carriage 18 is in the load position, a rear door (not shown) of the column 16 is opened to thereby provide access to the carriage 18. Once the rear door is opened, the mandrel 42 is swung out of a position between the top plate 30 and the bottom plate 32 of the housing 28. A link 64 is pivotally connected to the bottom plate 32 and includes the mandrel 42 thereon, thereby allowing the mandrel 42 to be swung out of the carriage 18. The front end of the stretch wrap 20 is then roped and placed on the film delivery hook 52 located between the first sprocket 52 and the seventh sprocket 63. The mandrel 42 is swung back into position in the carriage 18 once a new roll 26 of stretch wrap 20 is placed on the mandrel 42 (in phantom in FIG. 4). At this point, the film delivery system 48 is ready to move the stretch wrap 20 through the carriage 18.

Once the mandrel 42 is swung back on the carriage 18, the rear door is closed and the wrap machine 10 is in thread mode. The wrap machine 10 can be placed into thread mode automatically when the rear door is closed or the button can be pressed to place the wrap machine 10 in thread mode. To begin threading the stretch wrap 20 through the carriage 18 using the film delivery system 48, the tension control of the motor of the S-wrap roller system 36 is disengaged. However, the motor of the S-wrap roller system 36 is engaged at a low speed to turn the second roller 40. Simultaneous with the rotation of the second roller 40, a clutch 66 at the top of the second roller 40 is engaged to thereby rotate the second sprocket 54 of the film delivery system 48 with rotation of the second roller 40. The clutch 66 is preferably electromagnetically controlled and idles on the second roller 40 when the clutch 66 is not activated. Accordingly, as the second sprocket 54 is rotated, the threading chain 50 will pull the front end of the stretch wrap 20 about the first roller 38, the second roller 40, the third roller 44 and position the front end of the stretch wrap 20 under the fifth sprocket 60 and between the pair of take-off rollers 46. The front end of the stretch wrap 20 can thereafter be pulled from the position between the pair of take-off rollers 46 and attached to the package being wrapped or placed into position on grippers of the gripping and cutting device to begin the process of wrapping the package 24. The film delivery system 48 preferably includes a sensor 68 for counting teeth of the third sprocket 56 to determine the position of the film delivery hook 52 carrying the front end of the stretch wrap 20. The sensor 68 counts the number of teeth of the third sprocket 56 and signals the control system to stop the threading chain 50 after the number of teeth passing the sensor 68 is equal to the number of teeth required to pass the sensor 68 to move the film delivery hook 52 from the load position to a position between the pair of take-off rollers 46. The sensor 68 thereby stops the threading chain 50 when the front end of the stretch wrap 20 is in position to be removed from the carriage 18. At this point, the clutch 66 is disengaged and the wrap machine 10 is ready to be used in a manner known to those skilled in the art. Therefore, the wrap machine 10 of the current invention provides both a feed for threading the stretch wrap 20 through the carriage 18 and for prestretching of the stretch wrap 20 using only one motor, the motor previously used only for prestretching.

Figure 8:
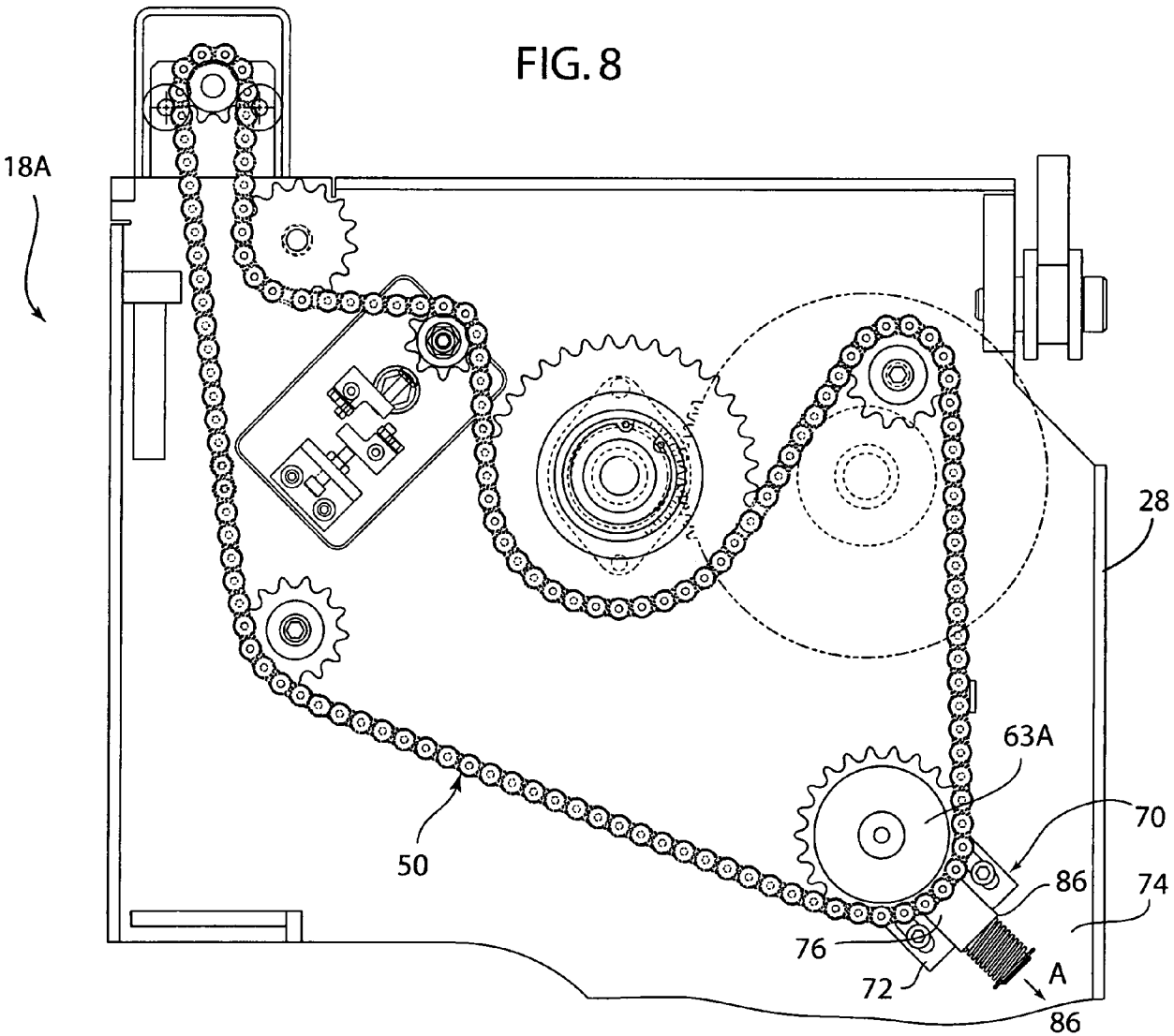
FIG. 8 is a partially fragmentary top view of the carriage according to another aspect of the present invention without the motor.
Figure 9:
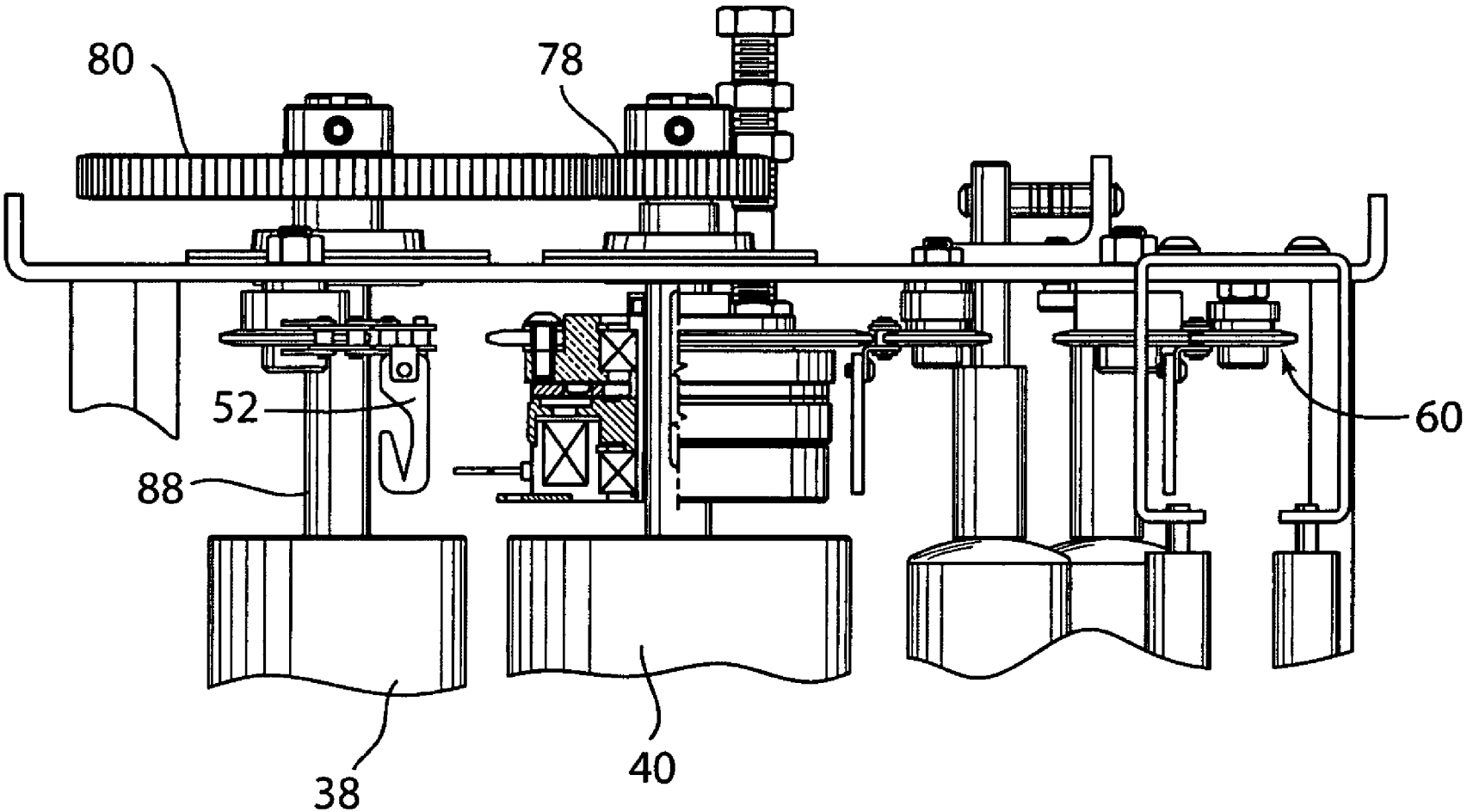
FIG. 9 is a fragmentary side view of the carriage of FIG. 8.
Figure 10:
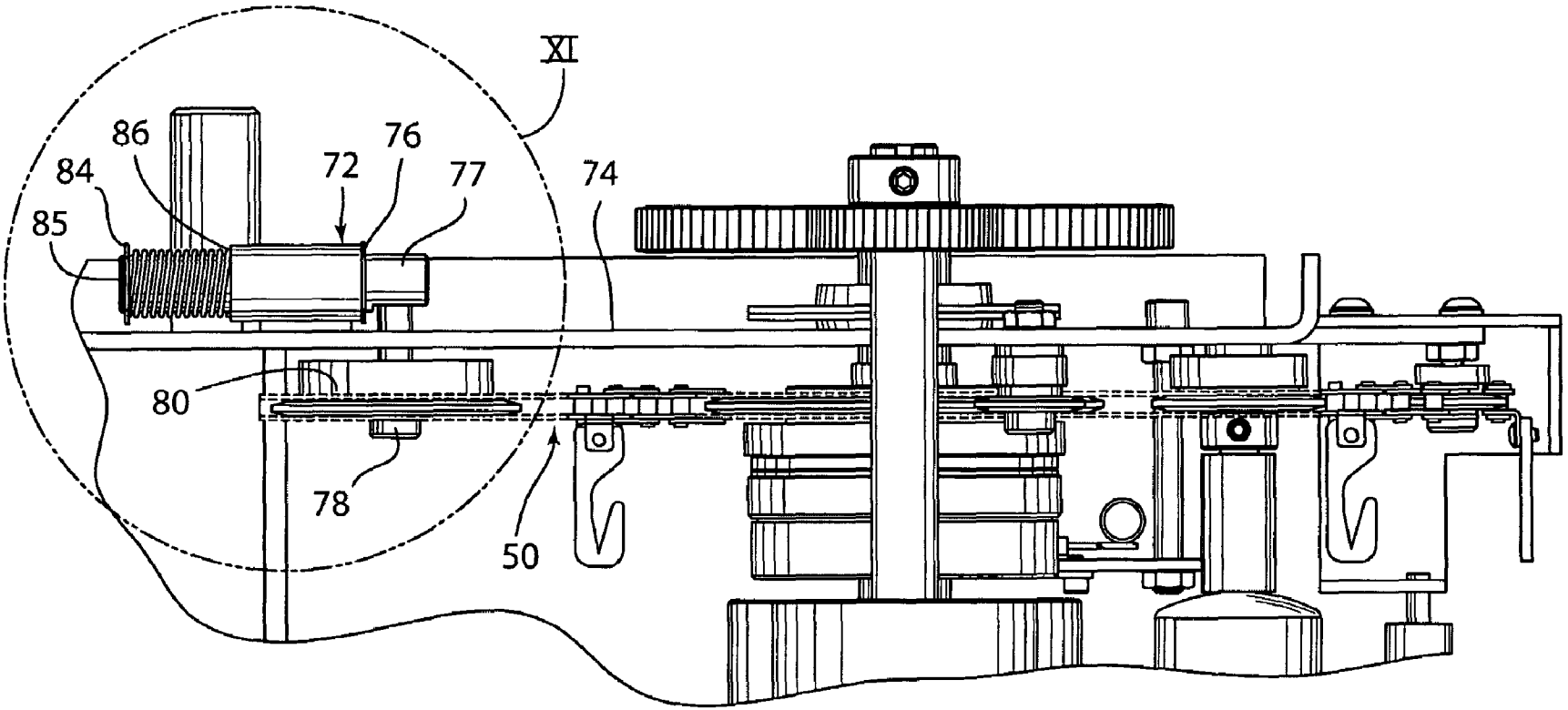
FIG. 10 is a fragmentary, end view of the carriage of FIG. 8.
Figure 11:
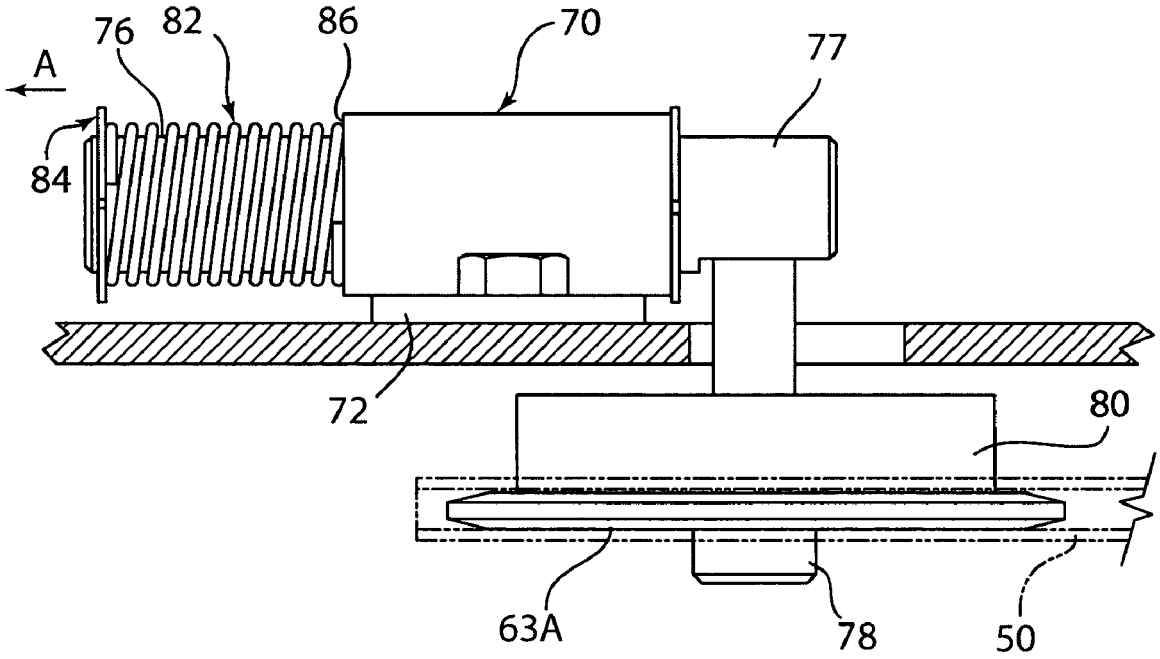
FIG. 11 is an enlarged view of the tensioner of FIG. 10.

With further reference to FIGS. 8–11, a carriage 18A according to another aspect of the present invention is substantially similar to the carriage 18 described in more detail above. However, the sprocket 63A of carriage 18A is mounted on a spring tensioner 70 that tensions the chain 50. A bracket 72 is mounted to a web 74 of housing 28. A sliding member 76 is movably retained by the bracket 72, and a shoulder screw 78 and bushing 80 rotatably mount the pulley 63A to the end 77 of slide member 76. A compression spring 82 is retained on the slide member 76 by a retaining ring 84 at the end 85 of slide member 76. The spring 82 is compressed between the edge 86 of bracket 72 and ring 84, and thereby generates a force in the direction of the arrow "A" (FIG. 8). The spring tensioner 70 thereby tensions the threading chain 50 to ensure free wheeling of the threading chain, and also to ensure constant tension during the threading process.

It will be readily understood that the S-wrap roller system 36 described above is only one o the stretcher configurations that may utilize the threader of the present invention. For example, known stretchers may have a W-wrap roller system, with a relatively large stretch roller at each lower "point" of the W pattern, and nip rollers at each upper end and the center "point" of the W pattern. The two stretch rollers of W-wrap systems are driven in the same rotational direction. The two stretch rollers may be driven at different rotational rates, and may have different diameters to stretch the film. When a W-wrap pattern is utilized, the electromagnetic clutch is operably connected to one of the stretch rollers, and sprockets are positioned at the ends of each roller to guide the chain and from a W pattern for threading of the film.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A combination film stretcher and dispenser, comprising:

a support structure;

a film support connected to the support structure for supporting a roll of film;

first and second stretch rollers rotatably connected to the support structure, the first and second stretch rollers being spaced apart to permit a sheet of film to wrap around the stretch rollers, and pass therebetween;

at least one guide roller spaced apart from the first and second stretch rollers and defining therewith a curvilinear film path including arcuate portions defined by outer surfaces of the first and second stretch rollers and the guide roller;

a single motor operably connected to the first and second stretch rollers and rotating the first and second stretch rollers to stretch film extending between and wrapping around the first and second stretch rollers;

first and second guides positioned adjacent ends of the first and second stretch rollers, respectively;

a third guide connected to the support structure and positioned adjacent an end of the guide roller;

a film threading device including an elongated flexible member engaging the first, second and third guides and forming a loop, at least a portion of the loop having a shape that is substantially similar to a shape of the curvilinear film path, the film threading device including a retainer connected to the elongated flexible member, the retainer configured to hold an end portion of a sheet of film and pull the film along the curvilinear film path as the elongated flexible member is moved;

a drive member engaging the elongated flexible member and moving the elongated flexible member upon movement of the drive member;

a disengagable drive device operably interconnecting the drive member and the single motor;

the disengagable drive device having an engaged configuration wherein the single motor simultaneously moves the drive member, elongated flexible member and retainer, and the first and second stretch rollers, the single motor providing substantially the sole source of power moving the first and second stretch rollers and the drive member, elongated flexible member and the retainer when the disengagable drive device is in the engaged configuration and thereby threads film through the combination film stretcher and dispenser; and the disengagable drive device having a disengaged configuration wherein the disengagable drive device operably disconnects the drive member from the single motor, such that the single motor moves the first and second stretch rollers and stretches film without moving the drive member and elongated flexible member.

2. The combination film stretcher and dispenser of claim 1, wherein:

the first, second and third guides comprise sprockets; and the elongated flexible member comprises a chain.

3. The combination film stretcher and dispenser of claim 2, wherein:

the retainer comprises a hook-like member.

4. The combination film stretcher and dispenser of claim 1, wherein:

the single motor has a rotatable output member that is connected to the second stretch roller by a drive member such that rotation of the output member rotates the second stretch roller;

gears interconnecting the first and second stretch rollers and rotating the first stretch roller upon rotation of the second stretch roller.

5. The combination film stretcher and dispenser of claim 4, wherein:

the gears rotate the first and second stretch rollers at different rotational rates.

6. The combination film stretcher and dispenser of claim 1, wherein:

the second guide comprises a sprocket engaging the elongated flexible member;

the disengagable drive device comprises a clutch selectively interconnecting the sprocket and the second stretch roller such that the sprocket rotates upon rotation of the second stretch roller when the clutch is in the engaged configuration and moves the elongated flexible member, the clutch disconnecting the sprocket from the second stretch roller when the clutch is in the disengaged configuration.

7. The combination film stretcher and dispenser of claim 6, including:

a sensor configured to measure the travel of the elongated flexible member; and a controller operably coupled to the sensor and to the clutch, the controller configured to change the clutch from the engaged configuration to the disengaged configuration after a predetermined amount of travel of the elongated flexible member.

8. The combination film stretcher and dispenser of claim 1, including:

a pair of take-off rollers defining parallel axes and first and second ends, wherein the take-off rollers ratably mounted to the support structure;

a fourth guide mounted to the support structure adjacent the first ends of the take-off rollers and positioning a portion of the elongated flexible member between the axes of the take-off railers.

9. The combination film stretcher and dispenser of claim 1, wherein:

the first, second and third guides comprise first, second, and third sprockets, respectively and the elongated flexible member comprises a chain, and including:

a tensioning sprocket engaging the chain, the tensioning sprocket being rotatably and slidably mounted to the support structure; and a resilient member biasing the tensioning sprocket into engagement with the chain.

10. A film stretching and dispensing apparatus, comprising:

a support structure;

a film support connected to the support structure, the film support configured to support a roll of film;

first and second stretch rollers rotatably connected to the support structure and defining first and second axes, respectively;

a film guide member connected to the support structure and being spaced apart from the first and second stretch rollers;

the first and second stretch rollers and the film guide member together defining at least a portion of a curvilinear film path extending from the film guide member around at least a portion of the first and second stretch rollers, and between the axes of the first and second stretch rollers;

a guide assembly connected to the support structure;

an elongated flexible member movably supported by the guide assembly and fanning a loop, at least a portion of the elongated flexible member having a shape that is substantially similar to a shape of the curvilinear film path;

a single motor having a rotating output member;

a drive assembly coupling the rotating output member to the first and second stretch rollers and rotating the first and second stretch rollers with sufficient force to stretch film between the first and second stretch rollers upon rotation of the rotating output member;

a drive member engaging the elongated flexible member and moving the elongated flexible member upon movement of the drive member;

a disengagable coupling selectively connecting and disconnecting the drive member and the rotating output member;

the disengagable coupling causing the drive member to move upon rotation of the rotating output member when the disengagable coupling connects the rotating output member and the drive member; and wherein:

the rotating output member rotates the first and second stretch rollers without moving the drive member when the disengagable coupling disconnects the rotating output member and the drive member.

11. The film stretching and dispensing apparatus of claim 10, wherein:

the guide assembly includes at least first, second, and third rotatable members, each of which engages the elongated flexible member.

12. The film stretching and dispensing apparatus of claim 11, wherein:

the first, second, and third rotatable members comprise sprockets;

the elongated flexible member comprises a chain.

13. The film stretching and dispensing apparatus of claim 10, including:

a hook-like retaining member connected to the elongated flexible member.

14. The film stretChing and dispensing apparatus of claim 10, wherein:

the drive assembly includes a first gear mounted to the first stretch roller, a second gear connected to the second stretch roller and meshingly engaging the first gear.

15. The film stretvbing and dispensing apparatus of claim 14, wherein:

the drive member comprises a rotatable member engaging the elongated flexible member and moving the elongated flexible member upon rotation of the rotatable member;

the disengagable coupling comprising a clutch selectively connecting and disconnecting the rotatable member from the rotating output member.

16. The film stretching and dispensing apparatus of claim 15, wherein:

the rotatable member comprises a sprocket that is interconnected to the second stretch roller by the clutch.

* * * * *

UNITED STATES PATENT AND TRADEMARK OFFICE

CERTIFICATE OF CORRECTION

PATENT NO. : 7,155,884 B2
APPLICATION NO. : 10/781257
DATED : January 2, 2007
INVENTOR(S) : Neil G. Cousins et al.

It is certified that error appears in the above-identified patent and that said Letters Patent is hereby corrected as shown below:

Column 6, Claim 8, Line 64; “ratably” should be --rotatably--.
Column 7, Claim 8, Line 2; “railers” should be --rollers--.
Column 7, Claim 10, Line 32; “fanning” should be --forming--.
Column 8, Claim 14, Line 25; “stretChing” should be --stretching--.
Column 8, Claim 15, Line 32; “stretvbing” should be --stretching--.

Signed and Sealed this

Twenty-second Day of May, 2007

JON W. DUDAS
*Director of the United States Patent and Trademark Office*